United States Patent [19]

Tanaka et al.

[11] Patent Number: 4,620,783

[45] Date of Patent: Nov. 4, 1986

[54] COLOR IMAGE FORMING APPARATUS

[75] Inventors: Kiyoharu Tanaka; Kenji Yoshinaga; Kenji Takeda; Shinichi Oguri, all of Yokohama; Yusaku Takada; Akio Ohno, both of Tokyo, all of Japan

[73] Assignee: Canon Kabushiki Kaisha, Tokyo, Japan

[21] Appl. No.: 740,493

[22] Filed: Jun. 3, 1985

[30] Foreign Application Priority Data

Jun. 8, 1984 [JP] Japan ..... 59-117656

[51] Int. Cl.[4] ..... G03G 15/06

[52] U.S. Cl. ..... 355/14 D; 355/4

[58] Field of Search ..... 355/14 D, 3 DD, 3 R, 355/4; 118/688, 693, 691

[56] References Cited

FOREIGN PATENT DOCUMENTS 171069 10/1983 Japan ..... 355/14 D 189669 11/1983 Japan ..... 355/14 D

*Primary Examiner*—R. L. Moses

*Attorney, Agent, or Firm*—Fitzpatrick, Cella, Harper & Scinto

[57] ABSTRACT

A color image forming apparatus wherein a plurality of developing devices or units are supported on a supporting member or turret which is rotatable to revolve the developing devices to move a desired one of the developing devices to a developing station where the developing operation is effected with the desired one of the developing devices so that a color image is formed. The presence, absence or the amount of the developer within the developing devices are detected. When the detection indicates that the toner is to be supplied into a developing device, the developing device is moved to a predetermined developer supplying position, and then is stopped so that the developing device is supplied with the developer at the developer supplying position.

8 Claims, 8 Drawing Figures

COLOR IMAGE FORMING APPARATUS

BACKGROUND OF THE INVENTION

The present invention relates to a color image forming apparatus such as a color electrophotographic copying apparatus for forming a multi-color (two-color or three-color) image or a full-color image and a color recording apparatus constituting an output station of a laser beam printer, a computer, a facsimile machine or the like.

Taking an electrophotographic copying apparatus as an example of a color image forming apparatus, it has been proposed that the apparatus comprises a photosensitive drum functioning as a latent image bearing member and a plurality of developing devices disposed around the photosensitive drum, the developing devices containing different colors of developing agents (U.S. Pat. No. 3,854,449), and that a plurality of the developing devices are supported on a supporting member or turret which is rotatable to revolve the developing devices so that a desired one of them can be moved to oppose the photosensitive drum at a developing station (U.S. Pat. No. 3,987,756).

The latter type is advantageous in that only one of the developing devices is opposed to the image bearing member whereby the peripheral length of the latent image bearing member is minimized.

However, this structure is somewhat disadvantageous in that the maintenance operation and the developer supplying operation tend to be complicated since the plurality of the developing devices are revolvable with the rotation of the supporting member. Therefore, it is desired to provide some means for enabling the operator or a serviceman to supply the correct developers to the developing devices with sure certainty.

SUMMARY OF THE INVENTION

Accordingly, it is a principal object of the present invention to provide a color image forming apparatus wherein the developing devices can be supplied with correct developers without difficulty and with ease.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
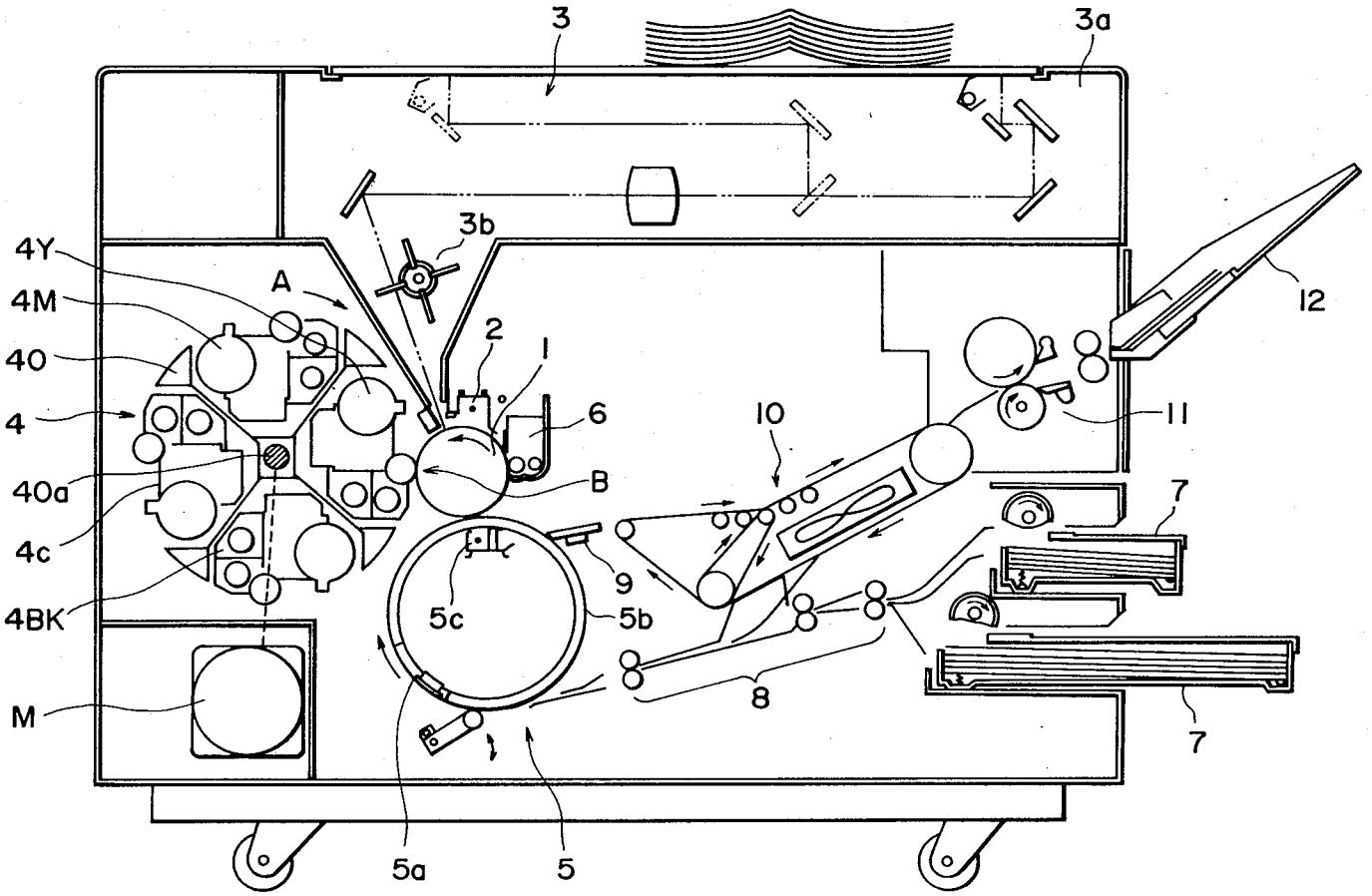
FIG. 1 is a cross-sectional view of a color electrophotographic copying apparatus to which the present invention is applicable.

Referring to FIG. 1, there is shown a color electrophotographic copying apparatus as an example of color image forming apparatus to which the present invention is applicable.

The apparatus in this FIG. comprises a photosensitive drum 1 as an image bearing member which is rotatable in a direction shown by an arrow. Around the photosensitive drum 1, there are disposed a charger 2, an image exposure optical system 3, a developer assembly 4, a transfer station 5 and a cleaning means 6. The optical system 3 includes an original scanning means **3*a* and a color-separating filters 3*b*. The photosensitive drum 1 is uniformly charged by a corona discharger 2 and then exposed to a color-separated light image through an optical system 3. By this exposure to the light image, a latent image is formed on the photosensitive drum 1. The developer assembly 4 comprises an yellow toner developing device 4Y, a magenta toner developing device 4M, a cyan toner developing device 4C and a black toner developing device 4BK. Those developing devices 4Y, 4M, 4C and 4BK are detachably mounted on a supporting member or turret 40. The supporting member 40 is driven by a motor M to rotate about a shaft 40*a* in the direction shown by an arrow A. By the rotation of the supporting member 40, the above-described developing devices 4Y, 4M, 4C and 4BK** revolve so that the desired one of the developing devices is moved to the developing station B. Here, the revolution of the developing devices may be in the form of a circular movement, an elliptical movement or another endless movement. In this specification, the circular movement only is taken for the sake of simplicity of explanation. Each of the developing devices may have the structure as shown in the Japanese Patent Application Publication No. 20579/1980 filed by the assignee of this application. The detailed structure of each of the developing device will be described hereinafter.

The image transfer station 5 includes a transfer drum **5*b* having a known gripper 5*a* and a transfer charger 5*c* in the drum 5*b*. A transfer material is supplied out of a cassette 7 by a transporting roller 8 to the transfer drum 5*b*, where the transfer material is gripped by the gripper 5*a* and is wound around the transfer drum 5*b*. A toner image provided by developing the latent image on the photosensitive drum is transferred to the transfer material supported on the transfer drum 5*b* by the transfer charger 5*c***, and the transferring operation is repeated onto the same transfer material a plurality of times. Thus, a full-color image can be formed on the transfer material in accordance with the original image by repeating the steps each comprising forming a color-separated latent image of the original on the photosensitive drum; developing the latent image with a predetermined developer; and transferring the developed image onto the transfer material.

The transfer material which has been subjected to the image transfer operations is separated from the transfer drum **5*b* by separating means 9 and then transported to an image fixing device 11 by a transporting belt 10. There, the image is fixed, and then the transfer material is discharged out of the apparatus to a tray 12**.

Figure 2:
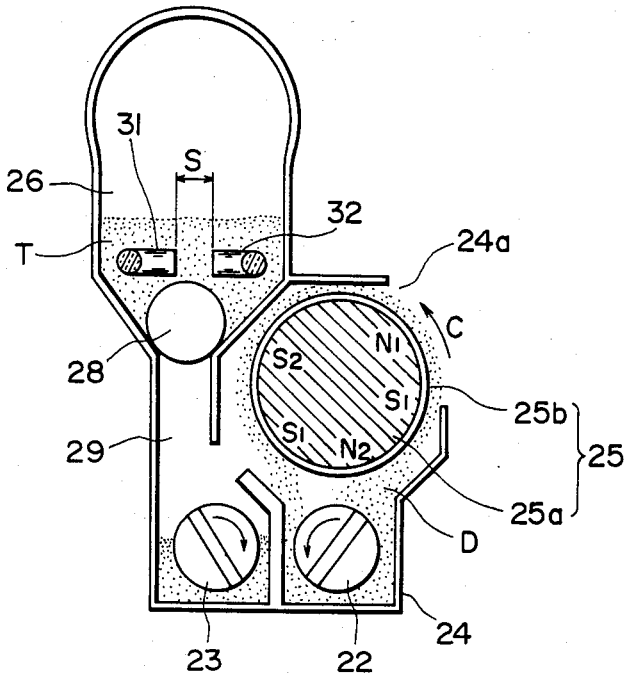
FIG. 2 is a cross-sectional view of one of developing devices.

FIG. 2 is a cross-sectional view of one of the developing devices.

The developing agent or developer D includes toner particles T and magnetic carrier particles mixed together. The developer D is conveyed in a developer container 24 by a screw 22 in the direction perpendicular to the sheet of the drawing of FIG. 2 from the front side to the back side thereof and by another screw 23 in the direction perpendicular to the sheet from the back side to the front side thereof, thus circulating within the container 24. During the transportation by the screw 22, the developer D is attracted by a magnetic force exerted by a magnet roller 25*a* and attached on a surface of a rotatable sleeve 25*b* in this embodiment, the magnet roller 25*a* and the rotatable sleeve 25*b* constitute a developing roller 25. The developing roller 25, as shown in the FIG., is partly exposed outside through a developing opening 24*a* of the developer container 24. When the sleeve 25*b* rotates in the direction of the arrow C, the developer D is supplied to the photosensitive drum to perform the developing action. The developer not consumed in the developing action and remained on the surface of the sleeve 25*b* is scraped off the sleeve 25*b* and returned into the container 24.

In order to supply the amount of the toner consumed by the developing action, the toner is supplied from a hopper 26 through a shutter 28 in a suitable manner and is stirred and mixed with the carrier particles in the container 24 by the returning screw 23.

Figure 3:
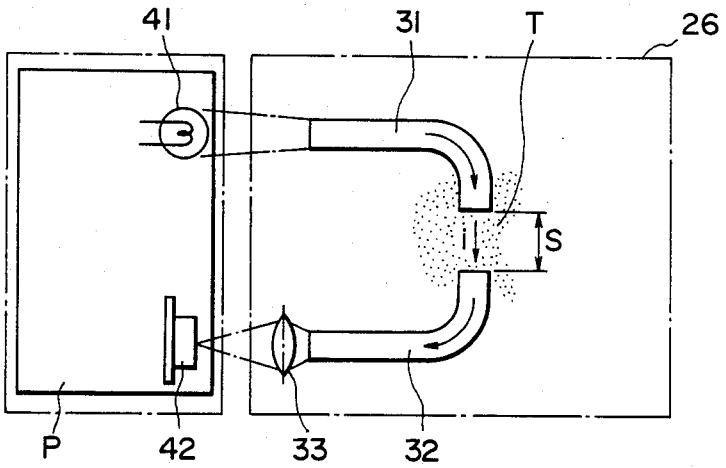
FIG. 3 illustrates means for detecting the toner present in a developing device.

The description will be made with respect to means for detecting the presence of the toner in the hopper 26 in conjunction with FIG. 3.

Adjacent the bottom of the hopper 26, a couple of bundles of optical fibers 31 and 32 is disposed in the manner that their end faces are opposed to each other. The couple of the optical fiber bundles 31 and 32 are used to detect whether or not the toner is still in the hopper 26. The couple is provided in each of the developing devices 4Y, 4M, 4C and 4BK. In this embodiment, the toner detecting operation is effected when the developing device is set at the developing station B (in FIG. 1, the developing device 4Y is set at the developing station B). More particularly, the copying apparatus is provided with detecting means P having a light source 41 and a light receiving element 42 fixed to the apparatus, which are optically connected with the respective optical fibers 31 and 32 when the developing device is set at the developing station, as shown in FIG. 3. In this state, the toner detecting path is completed. The optical fibers 31 are effective to introduce the light i from the light source 41 into the hopper 26, and the light i illuminates the end face of the light fiber bundle 32 which are disposed spaced therefrom with the clearance S. If there are toner particles in the clearance S, the light i introduced by the optical fibers 31 is absorbed by the toner particles T so that it does not reach the optical fibers 32. If, on the contrary, there is no toner T, the light i reaches the end face of the bundle of fibers 32 and directed toward outside of the developing device. The light is received by the light receiving element 42 through a lens 33 which is effective to prevent divergence of the light. The light receiving element 42, when receiving the light, actuates necessary elements to display "no toner" on the operation panel so that the operator is informed of the necessity of supplying the toner.

In this embodiment, when the toner is to be supplied to a developing device, the developing device is first moved to a predetermined toner supplying position, and then the developer assembly 4 is stopped. This will be described in detail hereinafter.

Figure 4:
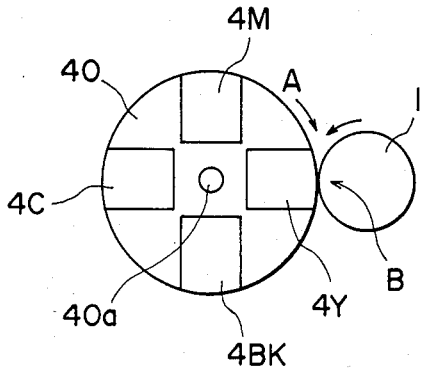
FIG. 4 is a schematic view of a developer assembly where one of developing devices is set at a developing station.
Figure 5:
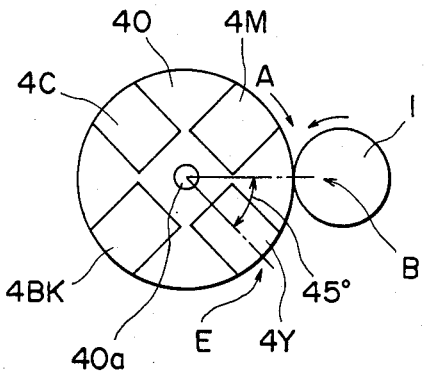
FIG. 5 is a schematic view of a developer assembly where one of the developing devices is set at a toner supplying position.

FIG. 4 shows a position of the developer assembly 4 where the developing device 4Y is set at the developing station B, and FIG. 5 shows the position where the developing device 4Y is set at a toner supplying position E. In this example, as will be understood from FIG. 5, the toner supplying position E is approximately 45 degrees downstream of the developing station B in to the direction A of the developing device movement.

Figure 6:
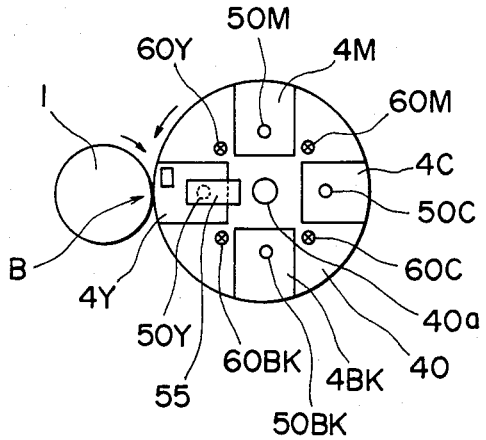
FIG. 6 illustrates means for identifying the developing devices.

The description will be made in conjunction with FIG. 6 with respect to means for identifying the developing device located at the developing station and the developing device located at the toner supplying position, more particularly, which of the four developing devices is located at the developing station or the toner supplying position. FIG. 6 is a schematic back side view of the developer assembly.

As for the identifying means, detecting means 55 fixed to the copying apparatus includes a lamp and a photodiode responsive to the incident light to produce a voltage in accordance with the quantity of the incident light thereto. On the other hand, each of the developing devices is provided with reflecting plate 50Y, 50M, 50C or 50BK. The reflecting plates have different reflection factors which are peculiar to the associated developing devices and they are disposed at such a position that each of them receives the light from the lamp and reflect it to the photodiode when it is located at the developing station. By this structure, the developing device currently usable for the developing operation and currently detected in the remaining amount of the toner can be identified on the basis of the output voltage level of the photodiode. In this manner, it can be directly detected or discriminated which of the developing devices is set at the developing station B.

Each of the developing devices is provided with another reflecting plate 60Y, 60M, 60C or 60 BK at such a position where said another reflecting plate is cooperable with said detecting means 55 when the developing device is located at the toner supplying position E. With those additional reflecting plates, the developing device located at the toner supplying position E can be identified in the similar manner.

The reflecting plates may be provided in the developing devices, in the supporting member or a disc which rotates together with the supporting member.

As for another example, the detecting means 55 may have a series of microswitches extending in the radial direction of the developer assembly 4. In this case, the developer assembly 4 is provided with projections each of which is disposed at a position peculiar to the associated developing device so as to actuate one of the microswiches. Then, the developing device is identified and the position thereof is detected on the basis of which microswitch is actuated.

Figure 7:
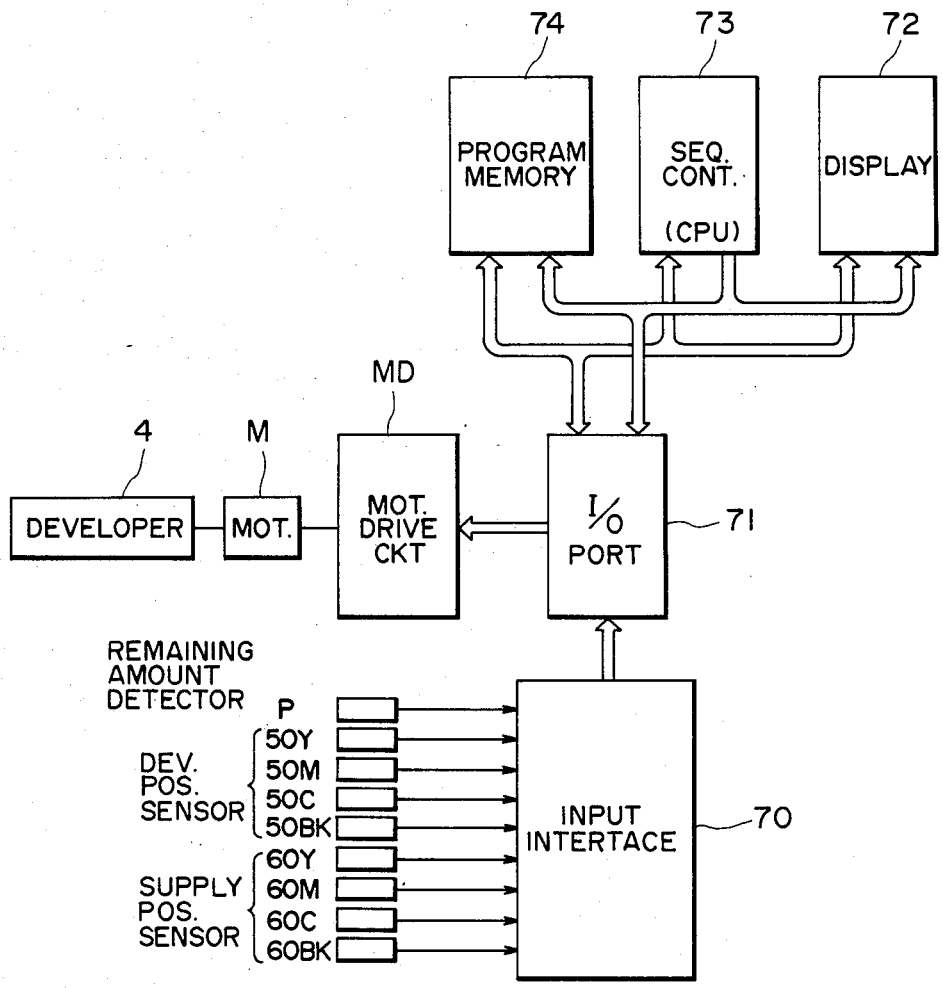
FIG. 7 is a block diagram for the sequential control.

FIG. 7 is a block diagram showing the sequential control of this embodiment.

A sequence controller (CPU) 73 controls an overall operation of the color image forming apparatus. When the developing device 4Y containing the yellow toner is in the process of development, the controller 73 detects by the signal from the position sensor 50Y that the developing device 4Y is at the developing station B. If the toner detecting sensor P detects that the amount of the toner is less than a predetermined, the detection signal is transmitted to the sequence controller (CPU) 73 through an input interface 70 and I/0 port 71. The CPU 73 acts on the program memory 74 so as to accomplish the developing operation to the final color with respect to only one copy being processed, to then transmit a signal to the motor driver MD to energize the motor M so that the toner lacking developing device, that is, the developing device 4Y in this example, is moved to the toner supplying position E. When the developing device 4Y reaches the toner supplying position E, the detecting means 55 receives the signal from the supplying position sensor 60Y so that it is detected that the developing device 4Y comes to the supplying position E. On the basis of this detection signal, the CPU 73 stops the developing device 4Y and instructs the entire copying operation of the apparatus to stop. Then, the apparatus is waiting for the toner to be supplied to the developing device 4Y. Simultaneously, on the basis of the above detection signal, the warning lamp of "no toner" is turned on or flickered in the display portion 72 of the apparatus.

Figure 8:
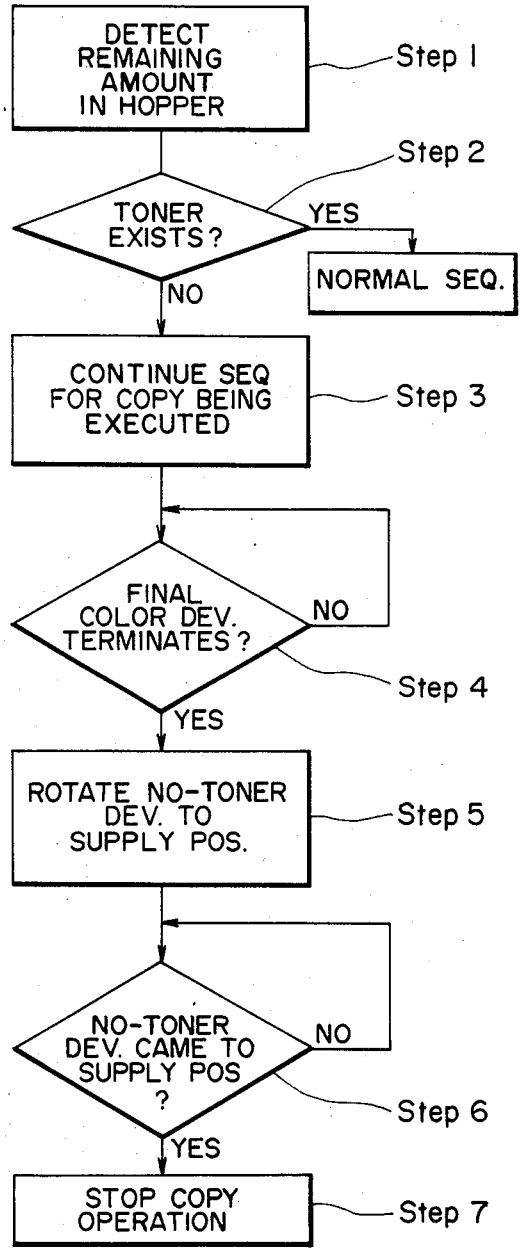
FIG. 8 is a flow chart showing control operations.

FIG. 8 is a flow chart of the control, with which the control operation will be described.

At step 1, the amount of the toner in the toner supplying hopper is detected with respect to the developing device present at the developing station B. If the detection shows the presence of the toner, the usual color copy producing operations are continued. If there is no toner, it is decided that the copying operation is continued with respect to the one copy being processed, at steps 2 and 3. Then, the discrimination is made at step 4 as to whether the one copy has been processed with "no toner". If so, the next color copy operation is deferred, and the toner lacking developing device is started to revolve to the toner supplying position E (FIG. 5), at step 5. When it is discriminated that the developing device comes to the predetermined toner supplying position at step 6, the copying operation is stopped to wait for the toner supply, at step 7.

Thus, the developing device which requires the toner supply is at rest at the toner supplying position E, so that the operator has only to supply the toner to the developing device located at the toner supplying position E. Therefore, the erroneous operation that the toner is supplied into a wrong developing device can be avoided.

As for the method of toner supply, a cylindrical toner cartridge containing therein the toner to be supplied may be inserted into the hopper of the developing device while the developing device is supported on the supporting member, or the developing device at the toner supplying position is taken out of the supporting member to supply the toner directly into the hopper.

It is preferable that the toner supplying position is the same as the developing device interchanging or exchanging position, since when one of the developing devices is set at the toner supplying position, the other developing device or devices are away from the photosensitive drum, whereby the photosensitive drum is not damaged when the developing device is exchanged or interchanged. The toner supplying operation and the developing device exchanging operations are carried out at the same position.

The detection of the presence and the absence of the toner is effected only to the developing device located at the developing station B. However, the detection may be effected to the developing device passing by the detecting position. However, since the toner is consumed during the developing operation at the developing station, it is preferable that the developing device is detected when it is at the developing station and being used for the development.

In addition to means for detecting the light transmitting type detector described above as for the toner detecting means, a vibration element such as a piezoelectric element may be provided in the developing device, of which the frequency of vibration changes with the amount of the toner remained in the hopper. The change in the frequency may be detected in the main apparatus with the use of a coupling transformer as a change in the voltage.

Further, a coil may be provided in the developing device, so that the change in the permeability to used, which is converted to a change in the voltage.

In the foregoing embodiments, the developer comprises toner and carrier particles (two component developer) and the remaining amount of the toner particles is detected. However, when the developer comprises toner only (one component developer), the remaining amount of the developer (toner) is detected.

As described in the foregoing, according to the present invention, the developer can be supplied with certainty and sure to the very developing device which requires the toner supply.

While the invention has been described with reference to the structures disclosed herein, it is not confined to the details set forth and this application is intended to cover such modifications or changes as may come within the purposes of the improvements or the scope of the following claims.

What is claimed is:

1. A color image forming apparatus wherein a plurality of developing units are used to develop a latent image formed on an image bearing member corresponding to a color component to provide a color comprising image:

a pluralty of developing units each containing a selected color of developer;

means for supporting the plurality of the developing units;

driving means for revolving the developing units to place a selected one of the developing units at a predetermined developing position;

means for detecting the developer contained in said developing units; and control means for controlling said driving means to move one of the developing units to a predetermined position for developer supply when said detecting means detects the necessity of supplying the developer to said one of the developing units.

2. An apparatus according to claim 1, further comprising means for detecting said one of the developing units is at the developing position and means for detecting said unit is at the developer supplying position.

3. An apparatus according to claim 1, wherein said detecting means operates with respect to a said developing unit located at the developing position.

4. An apparatus according to claim 1, wherein said detecting means includes a couple of optical element.

5. An apparatus according to claim 1, wherein after said one of the developing unit is placed at the developer supplying position, an image forming operation of said apparatus is stopped.

6. An apparatus according to claim 1, wherein the developer supplying position is the same as the position for allowing the developing unit to be exchanged or interchanged.

7. An apparatus according to claim 1, wherein said control means, after detecting that it is necessary to supply developer to said one of the developing units, permits said color image forming apparatus to continue operating in order to provide the color image which is being formed, and thereafter, allows said driving means to move said one of the developing units to the predetermined position.

8. An apparatus according to claim 1, wherein a position whereat said detecting means detects the necessity of supplying developer is different from a position where said developer is supplied.

* * * * *